US006431994B1

(12) United States Patent
Firth

(10) Patent No.: US 6,431,994 B1
(45) Date of Patent: Aug. 13, 2002

(54) GOLF SWING AND BALL FLIGHT RECORDING SYSTEM

(76) Inventor: Malcolm Firth, 16 Gate House Rd., Fort Lauderdale, FL (US) 33308

( * ) Notice: Subject to any disclaimer, the term of this patent is extended or adjusted under 35 U.S.C. 154(b) by 0 days.

(21) Appl. No.: 09/434,806

(22) Filed: Nov. 5, 1999

(51) Int. Cl.[7] ..... A63B 69/36
(52) U.S. Cl. ..... 473/266
(58) Field of Search ..... 473/266, 207, 473/215, 276

(56) References Cited

U.S. PATENT DOCUMENTS 3,408,750 A * 11/1968 McCollough et al. ..... 473/266
3,820,133 A 6/1974 Adorney et al.
3,918,073 A 11/1975 Henderson et al.
5,174,566 A 12/1992 Kelnhofer
5,184,295 A 2/1993 Mann
5,210,603 A 5/1993 Sabin
5,249,967 A 10/1993 O'leary et al.
5,297,796 A 3/1994 Peterson
5,333,061 A 7/1994 Nakashima et al.
5,342,054 A 8/1994 Chang et al.
D360,464 S 7/1995 Nomura
5,827,127 A * 10/1998 Firth ..... 473/266

* cited by examiner

*Primary Examiner*—Mark S. Graham
*Assistant Examiner*—Raeann Gordon

(57) ABSTRACT

A golf swing and ball flight recording system for allowing golfers to visualize their swing from various angles, and the flight of the golf ball after the swing. The system includes a frame having a generally rectangular configuration and including a top, a rear, opposed sides, an open front and an open bottom. The top and the opposed sides each have cross members and the frame is dimensioned for receiving a club swinging golfer therein. A top fixed video camera is fixedly secured to the cross member of the top of the frame. A first side fixed video camera is fixedly secured to the cross member of a first of the opposed sides of the frame. A second side fixed video camera is fixedly secured to the cross member of a second of the opposed sides of the frame. A video recorder is in communication with the video cameras for recording images received by the video cameras. A movable video camera positioned adjacent to the rear of the frame. The movable video camera is supportable on the body of a person. The movable video camera is movable in a vertical plane for recording the image of a flight of a golf ball after being struck by a golfer positioned in the frame.

4 Claims, 2 Drawing Sheets

10
12
14
16
18
20
22
24
26
30
32
34
34
36
42
44

36
38
38
40
2
3
4

28
40
26
4
4

28

26

GOLF SWING AND BALL FLIGHT RECORDING SYSTEM

BACKGROUND OF THE INVENTION

1. Field of the Invention

The present invention relates to golf practice aids and more particularly pertains to a new golf swing and ball flight recording system for allowing golfers to visualize their swing from various angles, and the flight of the golf ball after the swing.

2. Description of the Prior Art

The use of golf practice aids is known in the prior art. More specifically, golf practice aids heretofore devised and utilized are known to consist basically of familiar, expected and obvious structural configurations, notwithstanding the myriad of designs encompassed by the crowded prior art which have been developed for the fulfillment of countless objectives and requirements.

While the known prior art may fulfill their respective, particular objectives and requirements, the prior art does not disclose a new golf swing and ball flight recording system. The known prior art employs stationary recording devices, which can be highly useful for recording the aspects of a golfer's swing. However, the recording of the result of the golfer's swing, namely the flight of the golf ball after the swing, is generally not suitably captured by stationary recording devices and their limited range of view. The typically significant upward and downward path of the flight of the golf ball after the ball is struck is difficult to capture with stationary recording devices. Therefore, while a golfer's swing may be fairly completely recorded by known swing recording systems, a full record of the swing of the golfer and the flight of the ball has been difficult, if not virtually impossible, to obtain with the known recording systems.

The golf swing and ball flight recording system according to the present invention substantially departs from the conventional concepts and designs of the prior art, and in so doing provides an apparatus primarily developed for the purpose of allowing golfers to visualize their swing from various angles, and the flight of the golf ball after the swing.

SUMMARY OF THE INVENTION

In view of the foregoing disadvantages inherent in the known types of golf practice aids now present in the prior art, the present invention provides a new golf swing and ball flight recording system construction wherein the same can be utilized for allowing golfers to visualize their swing from various angles, and the flight of the golf ball after the swing.

The general purpose of the present invention, which will be described subsequently in greater detail, is to provide a new golf swing and ball flight recording system apparatus and method which has many of the advantages of the golf practice aids mentioned heretofore and many novel features that result in a new golf swing and ball flight recording system which is not anticipated, rendered obvious, suggested, or even implied by any of the prior art golf practice aids, either alone or in any combination thereof.

To attain this, the present invention generally comprises a frame having a generally rectangular configuration and including a top, a rear, opposed sides, an open front and an open bottom. The top and the opposed sides each have cross members and the frame is dimensioned for receiving a club swinging golfer therein. A top fixed video camera is fixedly secured to the cross member of the top of the frame. A first side fixed video camera is fixedly secured to the cross member of a first of the opposed sides of the frame. A second side fixed video camera is fixedly secured to the cross member of a second of the opposed sides of the frame. A video recorder is in communication with the video cameras for recording images received by the video cameras. A movable video camera positioned adjacent to the rear of the frame. The movable video camera is supportable on the body of a person. The movable video camera is movable in a vertical plane for recording the image of a flight of a golf ball after being struck by a golfer positioned in the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf swing and ball flight recording system apparatus and method which has many of the advantages of the golf practice aids mentioned heretofore and many novel features that result in a new golf swing and ball flight recording system which is not anticipated, rendered obvious, suggested, or even implied by any of the prior art golf practice aids, either alone or in any combination thereof.

It is another object of the present invention to provide a new golf swing and ball flight recording system which may be easily and efficiently manufactured and marketed.

It is a further object of the present invention to provide a new golf swing and ball flight recording system which is of a durable and reliable construction.

An even further object of the present invention is to provide a new golf swing and ball flight recording system which is susceptible of a low cost of manufacture with regard to both materials and labor, and which accordingly is then susceptible of low prices of sale to the consuming public, thereby making such golf swing and ball flight recording system economically available to the buying public.

Still yet another object of the present invention is to provide a new golf swing and ball flight recording system which provides in the apparatuses and methods of the prior art some of the advantages thereof while simultaneously overcoming some of the disadvantages normally associated therewith.

Still another object of the present invention is to provide a new golf swing and ball flight recording system for allowing golfers to visualize their swing from various angles and the flight of the golf ball after the swing.

Yet another object of the present invention is to provide a new golf swing and ball flight recording system which includes a frame having a generally rectangular configuration and including a top, a rear, opposed sides, an open front and an open bottom. The top and the opposed sides each have cross members and the frame is dimensioned for receiving a club swinging golfer therein. A top fixed video camera is fixedly secured to the cross member of the top of the frame. A first side fixed video camera is fixedly secured to the cross member of a first of the opposed sides of the frame. A second side fixed video camera is fixedly secured to the cross member of a second of the opposed sides of the frame. A video recorder is in communication with the video cameras for recording images received by the video cameras. A movable video camera positioned adjacent to the rear of the frame. The movable video camera is supportable on the body of a person. The movable video camera is movable in a vertical plane for recording the image of a flight of a golf ball after being struck by a golfer positioned in the frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
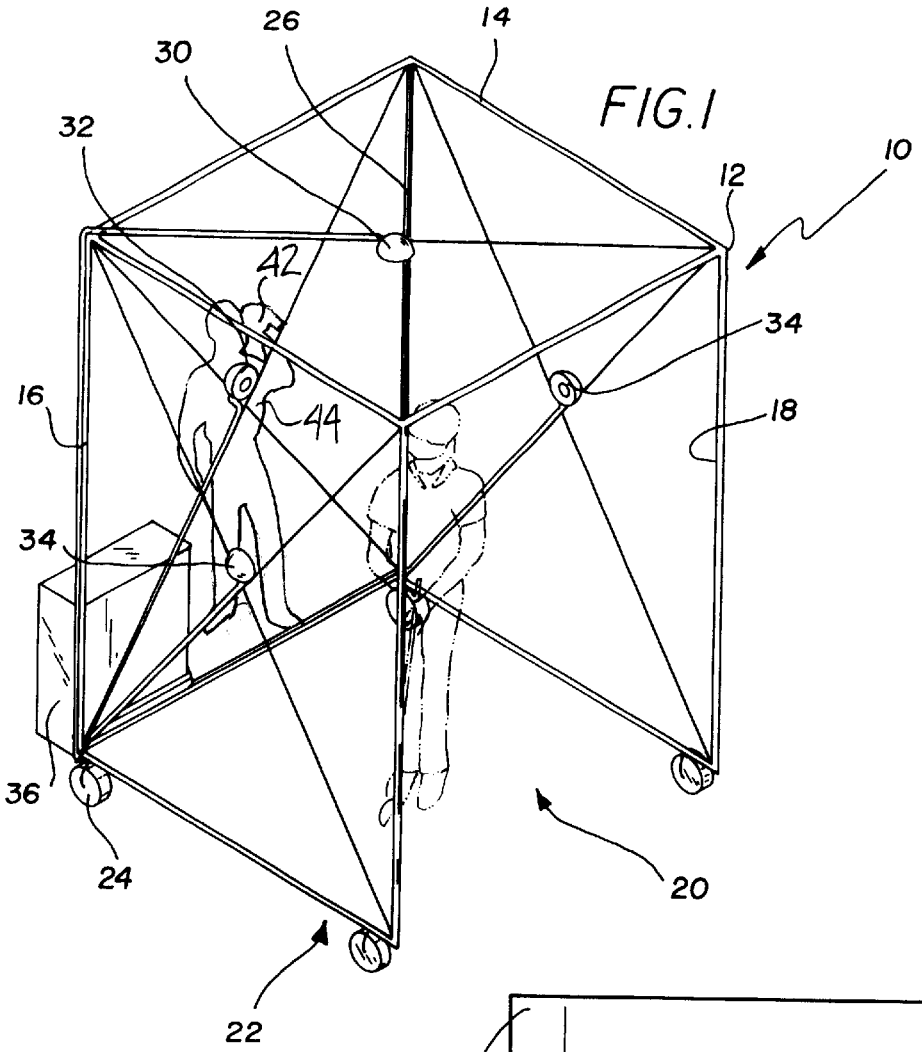
FIG. 1 is a perspective view of a new golf swing and ball flight recording system according to the present invention.
Figure 2:
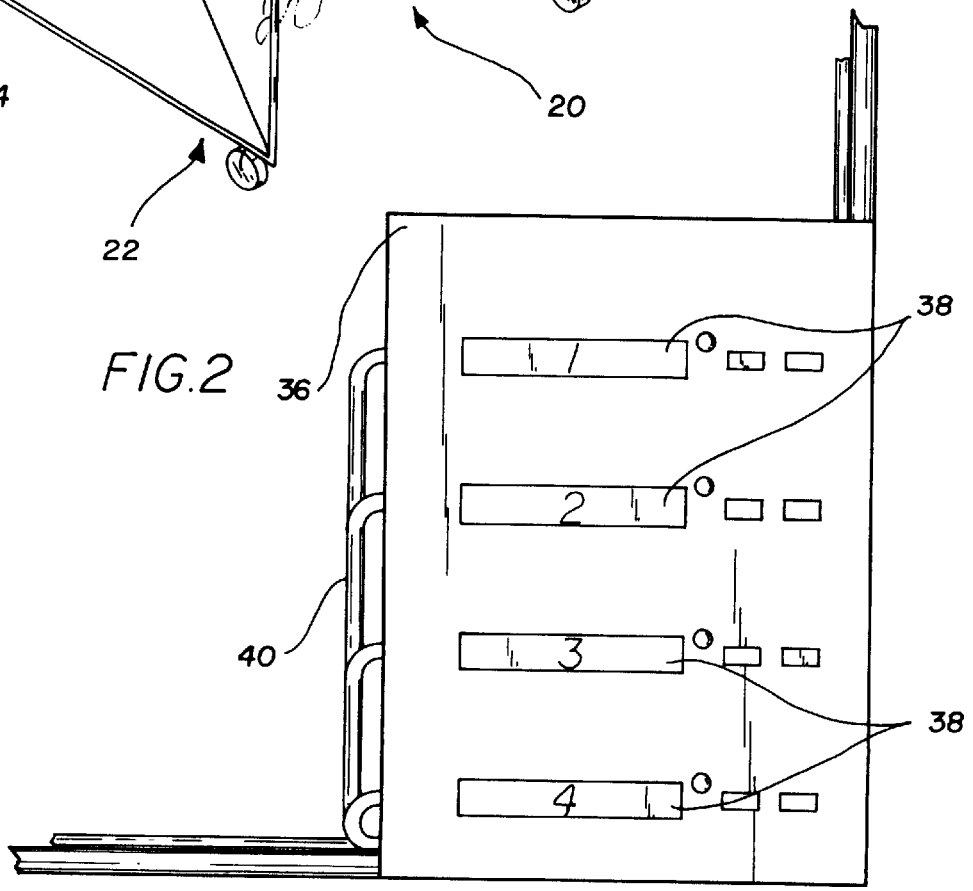
FIG. 2 is a front view of the video recorder unit of the present invention.
Figure 3:
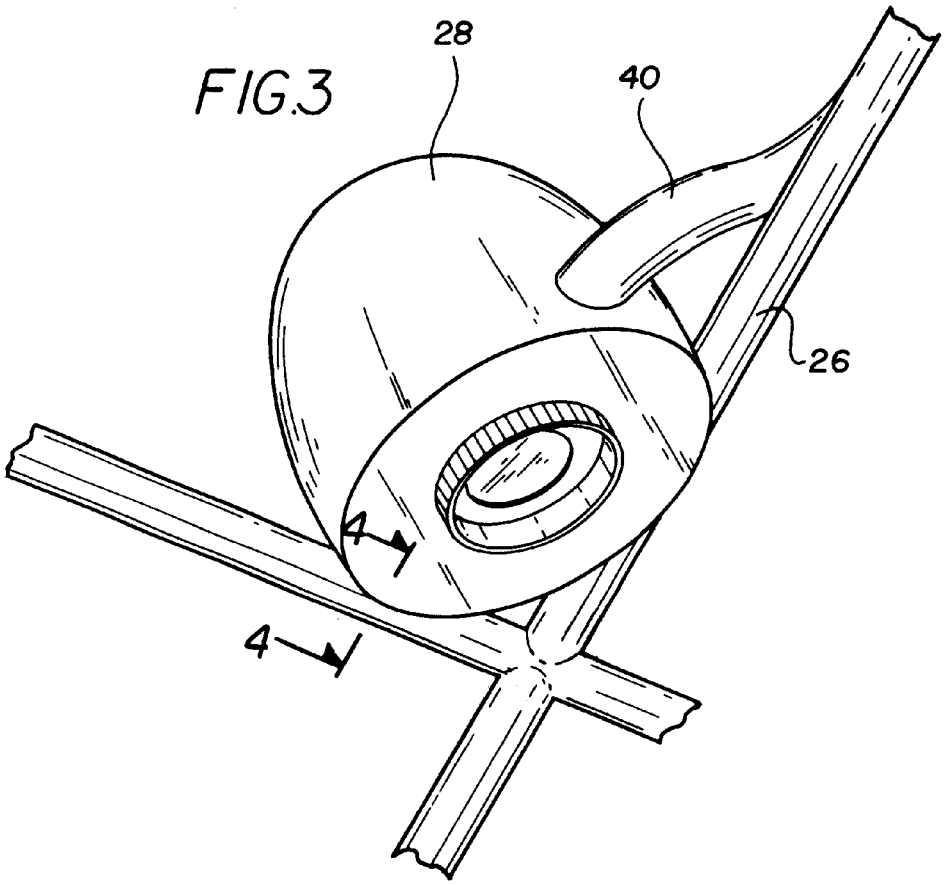
FIG. 3 is a perspective view of one of the cameras of the present invention.
Figure 4:
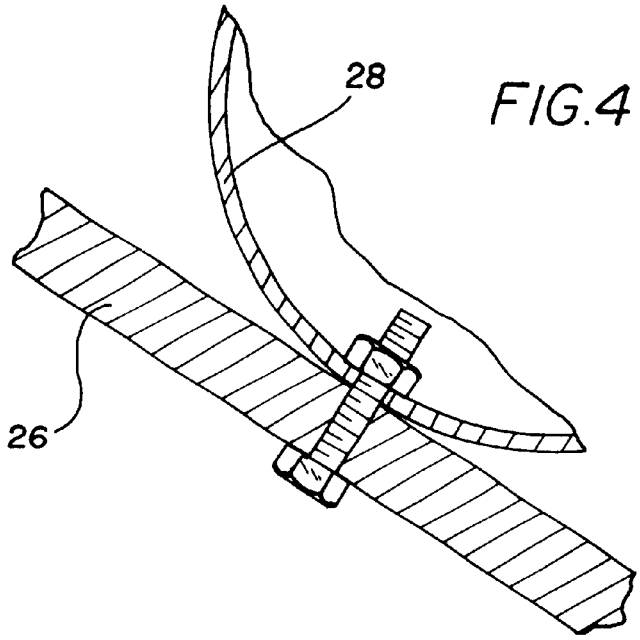
FIG. 4 is a cross-sectional view of the present invention as taken along line 4—4 of FIG. 3.

With reference now to the drawings, and in particular to FIGS. 1 through 4 thereof, a new golf swing and ball flight recording system embodying the principles and concepts of the present invention and generally designated by the reference numeral 10 will be described.

As best illustrated in FIGS. 1 through 4, the golf swing and ball flight recording system 10 comprises a frame 12 having a generally rectangular configuration. The frame 12 includes a top 14, a rear 16, opposed sides 18, an open front 20 and an open bottom 22. The top and the opposed sides each have cross members 26. The cross members extend from diagonally opposed locations on the frame.

The frame defines an interior, and the interior is dimensioned for receiving a club swinging golfer therein. The frame also has wheels 24 mounted thereon adjacent to the open bottom 22 of the frame 12.

A top fixed video camera 30 is fixedly secured to one of the cross members 26 of the top 14 of the frame 12. A first side fixed video camera 34 is fixedly secured to one of the cross members 26 of a first of the opposed sides of the frame 12. A second side fixed video camera is fixedly secured to one of the cross members 26 of a second of the opposed sides of the frame 12. Optionally, the rear of the frame has a diagonal cross member, and a rear fixed video camera 32 is fixedly secured to the cross member of the rear of the frame.

A video recorder 36 is provided which is in communication with the video cameras for recording images received by the video cameras. The video recorder is preferably secured to the rear 16 of the frame. In a highly preferred embodiment, the video recorder has a recording portion 38 corresponding to each of the video cameras for recording on tapes positioned in the video recorder. A cable 40 connects the various video cameras to the video recorder.

A highly significant aspect of the invention is a movable video camera 42 positioned adjacent to the rear 16 of the frame 12. Preferably, the movable video camera is adapted for support on the body of a person 44, such as, for example, on the shoulder of the person. The movable video camera 42 is adapted for movement in a vertical plane for recording the image of a flight of a golf ball after being struck by a golfer positioned in the frame. Preferably, the cross members of the frame are relatively thin such that the top, a rear, and opposed sides of the frame do not significantly obstruct the view of the movable video camera.

In use, the present invention 10 includes a method of recording a golfer's swing. The invention includes providing a frame as described above, with fixed top and a pair of side video cameras being fixedly secured to the cross members of the frame. The invention also includes positioning the movable video camera adjacent to the rear of the frame. Preferably, the movable video camera is supported on the shoulder of a person. The movable video camera is moved to follow the flight of a golf ball struck by a golfer positioned in the frame to capture the image of the golf ball in flight. The movable video camera is swung in a substantially vertical plane for following the upward flight and the downward flight of the golf ball. Also highly preferable is recording the golfer's swing with the fixed video cameras fixedly mounted on the frame prior to and during the striking of the golf ball, and recording the flight of the golf ball after the ball has been struck by the golfer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of recording a golfer's swing and the resulting flight of the golf ball, comprising:

providing a frame having a generally rectangular configuration, tile frame including a top, a rear, opposed sides, an open front and an open bottom, the top and the opposed sides each having cross members, the frame being dimensioned for receiving a club swinging golfer therein, a top fixed video camera being fixedly secured to the cross member of the top of the frame, a first side fixed video camera being fixedly secured to the cross member of a first of the opposed sides of the frame, and a second side fixed video camera being fixedly secured to the cross member of a second of the opposed sides of the frame;

positioning a movable video camera adjacent to the rear of the frame;

moving the movable video-camera to follow the flight of a golf ball struck by a golfer positioned in the frame to capture the image of the golf ball in flight.

2. The method of claim 1 wherein the act of moving the movable video camera comprises swinging the movable video camera in a substantially vertical plane.

3. The method of claim 1 additionally comprising the act of supporting the movable video camera on the shoulder of a person.

4. The method of claim 1 additionally comprising the act of recording the golfer's swing with the fixed video cameras fixedly mounted on the frame prior to and during the striking of the golf ball, and recording the flight of the golf ball after the ball has been struck by the golfer.

* * * * *